US007249981B2

(12) United States Patent
Chen

(10) Patent No.: US 7,249,981 B2
(45) Date of Patent: Jul. 31, 2007

(54) PRESS-FIT PIN

(75) Inventor: Ping Chen, West Bloomfield, MI (US)

(73) Assignee: J.S.T. Corporation, Farmington Hills, MI (US)

( * ) Notice: Subject to any disclaimer, the term of this patent is extended or adjusted under 35 U.S.C. 154(b) by 0 days.

(21) Appl. No.: 11/177,617

(22) Filed: Jul. 8, 2005

(65) Prior Publication Data

US 2007/0010139 A1 Jan. 11, 2007

(51) Int. Cl.
*H01R 13/42* (2006.01)

(52) U.S. Cl. ..... 439/751

(58) Field of Classification Search ..... 439/751, 439/82, 873, 75, 786, 825; 29/838, 879
See application file for complete search history.

(56) References Cited

U.S. PATENT DOCUMENTS 2,006,813 A 7/1935 Norwood
3,255,430 A * 6/1966 Phillips ..... 439/786
3,319,217 A * 5/1967 Phillips ..... 439/75
3,717,841 A * 2/1973 Mancini ..... 439/842
3,846,741 A 11/1974 Kunkie et al.
4,186,982 A * 2/1980 Cobaugh et al. ..... 439/82
4,230,384 A * 10/1980 Anhalt ..... 439/81
4,557,539 A 12/1985 Zust et al.
4,606,589 A 8/1986 Elsbree, Jr. et al.
4,698,026 A 10/1987 Rolf et al.
4,746,301 A 5/1988 Key
4,759,721 A 7/1988 Moore et al.
4,854,900 A 8/1989 Muhlhoff
4,857,018 A 8/1989 Pickles
4,857,019 A * 8/1989 Brubaker et al. ..... 439/751
4,867,710 A 9/1989 Harting et al.
4,889,496 A * 12/1989 Neidich ..... 439/75

(Continued)

FOREIGN PATENT DOCUMENTS

DE 2742716 A 4/1979

(Continued)

OTHER PUBLICATIONS

Notification of Transmittal of International Search Report and Written Opinion, International Search Report, and Written Opinion of the International Searching Authority for International Application PCT/US2006/005465 mailed Aug. 10, 2006 (12 pages).

*Primary Examiner*—Tulsidas C. Patel
*Assistant Examiner*—Vladimir Imas
(74) *Attorney, Agent, or Firm*—Osha Liang LLP

(57) ABSTRACT

A press-fit pin is press-fitted into a conductive through-hole disposed on a substrate such as a printed circuit board. The press-fit pin includes a contact portion, a shoulder portion, a press-fit portion, and a tip portion. The contact portion along with the shoulder portion is inserted into a housing of a connector to be mounted on the printed circuit board, thereby forming a terminal of the connector. The press-fit portion spirally extends downward from a lower portion of the shoulder portion and is connected to the tip portion. The press-fit portion has the property of elastic deformation. Thus, the press-fit portion comes into interference with the through-hole, thereby allowing the press-fit pin to be mechanically fixed to the printed circuit board.

10 Claims, 7 Drawing Sheets

U.S. PATENT DOCUMENTS 5,051,108 A * 9/1991 Lincoln ..... 439/825
5,073,119 A 12/1991 Soes et al.
5,131,872 A * 7/1992 Consoli et al. ..... 439/751
5,184,400 A * 2/1993 Cray et al. ..... 29/879
5,195,237 A * 3/1993 Cray et al. ..... 29/838
5,497,546 A * 3/1996 Kubo et al. ..... 29/843
5,667,412 A 9/1997 Takahashi et al.
5,897,401 A 4/1999 Fili et al.
6,077,128 A 6/2000 Maag et al.
6,217,346 B1 4/2001 Cubon
6,305,949 B1 10/2001 Okuyama et al.
6,443,768 B1 9/2002 Dirkers et al.
6,722,928 B1 4/2004 Noda et al.
2003/0236009 A1* 12/2003 Tsuchiya ..... 439/82
2004/0121627 A1 6/2004 Grube et al.
2004/0242082 A1* 12/2004 Tsuchiya ..... 439/751
2005/0093559 A1 5/2005 Mori et al.
2006/0035535 A1 2/2006 Kawahara et al.

FOREIGN PATENT DOCUMENTS

DE 19952934 5/2000
JP 60-258875 12/1985

* cited by examiner

PRESS-FIT PIN

BACKGROUND OF INVENTION

1. Field of the Invention

The invention relates generally to a press-fit pin, which is press-fitted into a through-hole disposed on a printed circuit board.

2. Background Art

In recent years, increasing awareness of environmental issues has focused attention on a junction technique using a press-fit pin or compliant pin as alternative to the soldering junction technique using lead material.

The press-fit pin junction technique is to mechanically fix a press-fit pin or compliant pin, which is an acicular terminal given the property of compressive elasticity, onto a printed circuit board by way of inserting the press-fit pin into a through-hole, whose diameter is slightly smaller than the width of the press-fit pin, of the printed circuit board, thereby ensuring a frictional force. A component such as a male connector is attached to the press-fit pin disposed on the print circuit board, thereby allowing lead-free mechanical and electrical interconnection.

The press-fit pin includes a press-fit portion to be in pressure contact with an internal surface of the through-hole of the printed circuit board. The press-fit portion may be manufactured by stamping out a pin-like shape from a metal plate and thereafter forming a slit (needle eye) at a center of the resulting pin in a longitudinal direction.

Securing a sufficient effective contact area and maintaining an adequate contact pressure are necessary for assuring fundamental performance in reliability of connection of the press-fit pin. For example, if the contact pressure is too small, the effective contact area is insufficient, resulting in deterioration in the reliability of the connection. In contrast, in a case where the contact pressure increases by using a press-fit pin in a larger size and shape in order to obtain higher contact pressure, a portion of the printed circuit board may be cracked due to improper insertion force. In addition, the press-fit pin may be damaged. This may cause an increase in electrical contact resistance.

SUMMARY OF INVENTION

A press-fit pin is press-fitted into a conductive through-hole disposed on a substrate such as a printed circuit board. The press-fit pin includes a contact portion, a shoulder portion, a press-fit portion, and a tip portion. The contact portion along with the shoulder portion is inserted into a housing of a connector to be mounted on the printed circuit board, thereby forming a terminal of the connector. The press-fit portion spirally extends downward from a lower portion of the shoulder portion and is connected to the tip portion. The press-fit portion has the property of elastic deformation. Thus, the press-fit portion comes into interference with the through-hole, thereby allowing the press-fit pin to be mechanically fixed to the printed circuit board.

Other aspects and advantages of the invention will be apparent from the following description and the appended claims.

DETAILED DESCRIPTION

Figure 1:
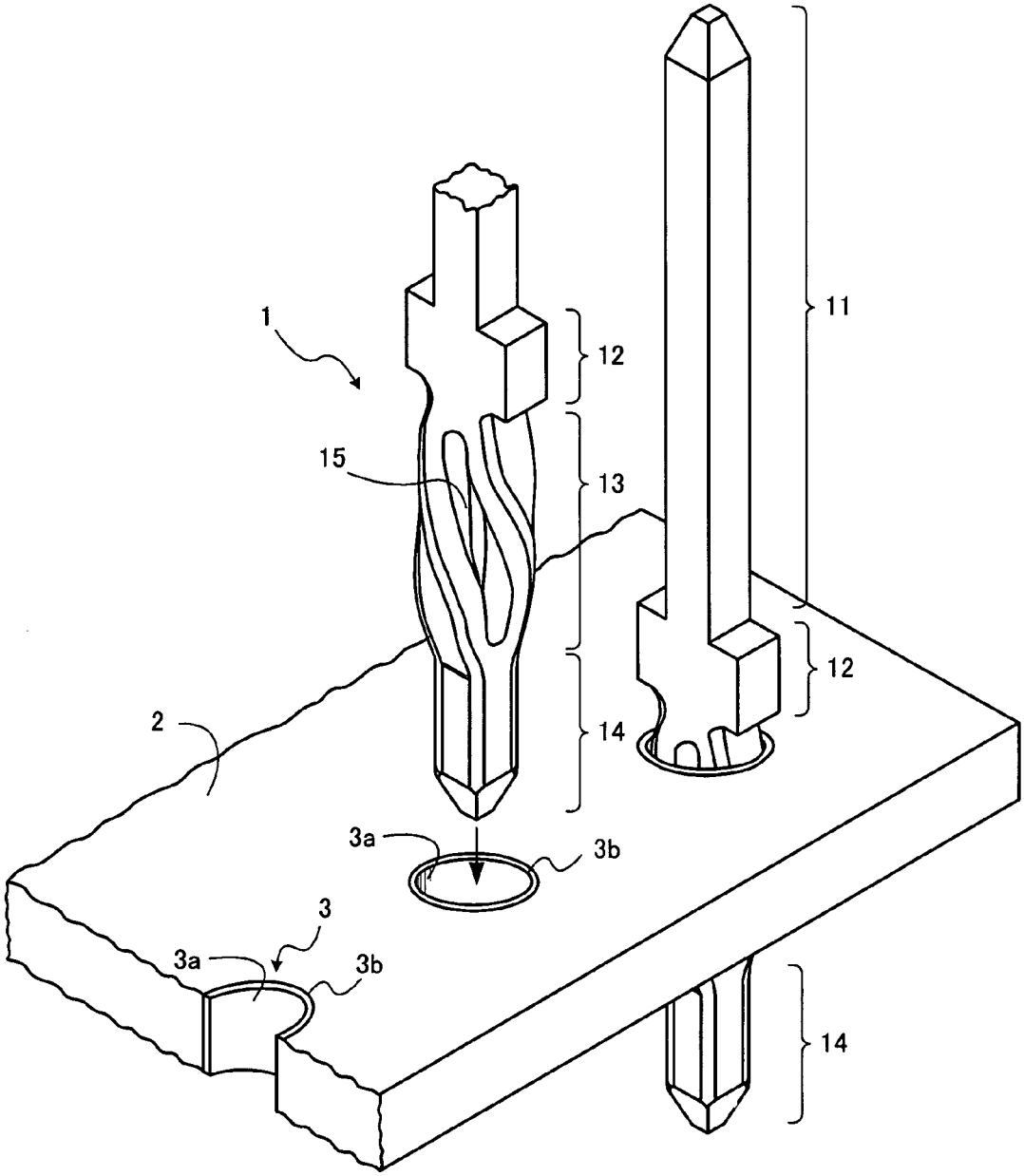
FIG. 1 shows a perspective of a press-fit pin according to one embodiment of the invention as the press-fit pin is being inserted into a printed circuit board.

FIG. 1 shows a perspective of a press-fit pin according to an embodiment of the invention as the press-fit pin is being inserted into a substrate such as a printed circuit board. As shown in FIG. 1, a press-fit pin 1 is press-fitted into a through-hole 3 formed on a printed circuit board 2. An inner surface 3*a* of the through-hole 3 is plated, and an opening 3*b* of the through-hole 3 forms a part of a profile of a circuit pattern (not shown). The press-fit pin 1 that is press-fitted into the printed circuit board 2 mechanically fixes a male connector thereto (not shown), forming a terminal of the male connector. The male connector mounted on the printed circuit board 2 is configured to connect to a mating connector, i.e., a female connector, thereby electrically interconnecting terminals of both connectors.

The press-fit pin 1 may be manufactured by stamping out a predetermined-shaped pin from a metallic plate made of, for example, copper alloy, pressing the stamped pin, and further twisting the pressed pin. The press-fit pin 1 may alternatively be formed using other known materials and methods. The press-fit pin 1 typically includes a contact portion 11, a shoulder portion 12, a press fit portion 13, and a tip portion 14. Dimensions of the press-fit pin 1 are determined to a large extent by a size and shape of the printed circuit board 2 and components, such as connectors, applied to the printed circuit board 2.

The contact portion 11 will form a terminal of the male connector as a final product by being inserted along with the shoulder portion 12 into a housing of the male connector that will be mounted on the printed circuit board 2. Thus, the contact portion 11 can electrically be in contact with a terminal of the female connector. The shoulder portion 12 fits into a receiving portion (not shown) disposed within the housing of the male connector, and mechanically fixes to the male connector, thereby allowing position of the terminal relative to the housing to be properly assured. The press fit portion 13 spirally extends downward from a lower portion of the shoulder portion 12. The press fit portion 13 comes in frictional contact with the inner surface 3*a* of the through-hole 3, allowing the press-fit pin 1 itself to be fixed. To this end, the press fit portion 13 is configured to be elastically deformable, and dimensions of the press fit portion 13 are selected to be slightly larger than a diameter of the through-hole 3. For example, a slit (needle eye) 15 may be formed on a portion to be the press fit portion 13 in a longitudinal direction, and the portion having the slit 15 is spirally expanded outward along the longitudinal direction, causing the press fit portion 13 to be elastically deformable in the traverse or radial direction by its torsion. The tip portion 14 is disposed at a lower portion of the press fit portion 13. The tip portion 14 serves as a positioning and setting mechanism during the process of press-fitting into the through-hole 3.

Figure 2:
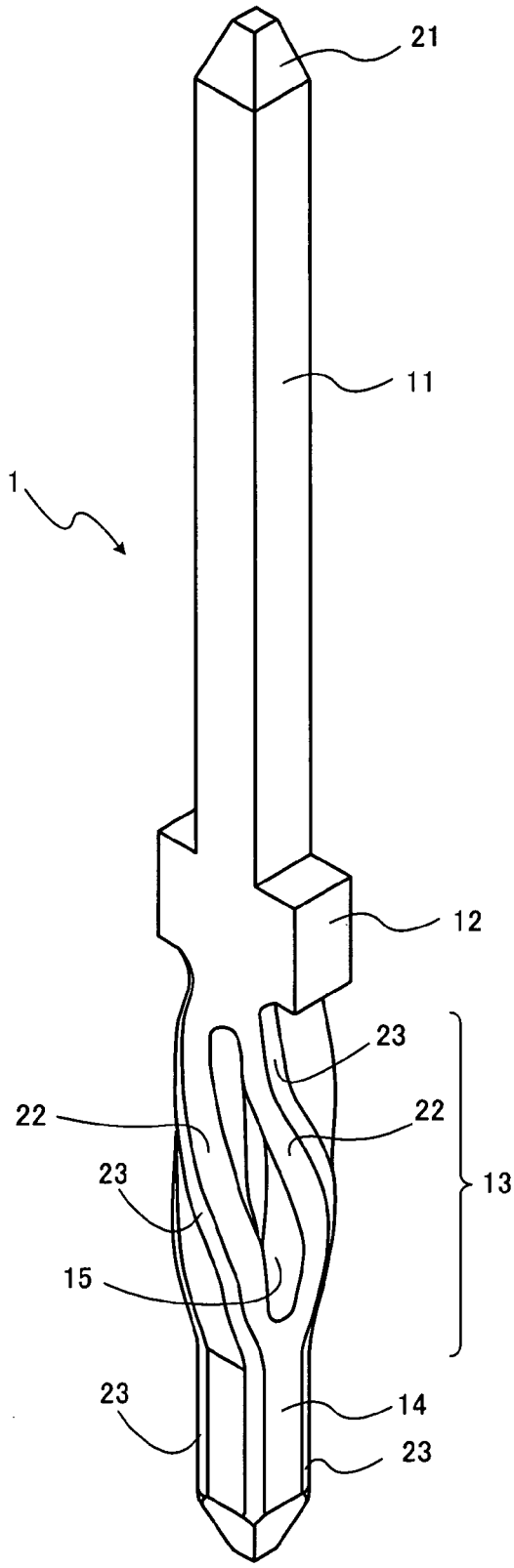
FIG. 2 shows a perspective view of a press-fit pin according to one embodiment of the invention.

FIG. 2 shows a press-fit pin in detail according to an embodiment of the invention. The press-fit pin is characterized in that a portion of the press-fit pin 1 is spirally-twisted in a longitudinal direction thereof.

Referring to FIG. 2, the contact portion 11 includes a tapered portion 21 at a distal end thereof. The contact portion 11 serves as a terminal of the male connector as discussed above. The shoulder portion 12 is disposed at the proximate end of the contact portion 11. The shoulder portion 12 is formed in a rectangular shape in cross section against other shapes. The shoulder portion 12 extends outward beyond the width of the press fit portion 13. The shoulder portion 12 prevents the press-fit pin 1 from passing through the through-hole 3 of the printed circuit board 2, engaging with the opening 3*b* of the through-hole 3, even if an excessive insertion force is applied to the press-fit pin 1.

The press fit portion 13 frictionally contacts with the inner surface 3*a* of the through-hole 3 by pressure contact in accordance with elastic deformation thereof. The press fit portion 13 comprises two arm portions 22, which define the slit 15, configured in a double spiral structure. Specifically, the arm portions 22 branching off from the shoulder portion 12 spirally extend and merge together, being connected to the tip portion 14. By this configuration, the press fit portion 13 can elastically be deformed in a spiral direction substantially along the longitudinal axis of the press-fit pin 1, thereby obtaining an adequate frictional force. Further, in a process of press-fitting, the press-fit portion 13 effectively removes extraneous matter, such as oxide film or dust, from the inner surface 3*a* of the through-hole 3. Furthermore, an effective contact area between the press-fit portion 13 and the through-hole 3 increases, thereby resulting in reducing electrical contact resistance. A lower portion of the press-fit portion 13 may be configured in a tapered shape in order to reduce excessive interference with the through-hole 3 at an early stage of the insertion process. Outer edges or corners 23 of the press-fit portion 13 and the tip portion 14 subsequent to the press-fit portion 13 may be chamfered or rounded.

Figure 3:
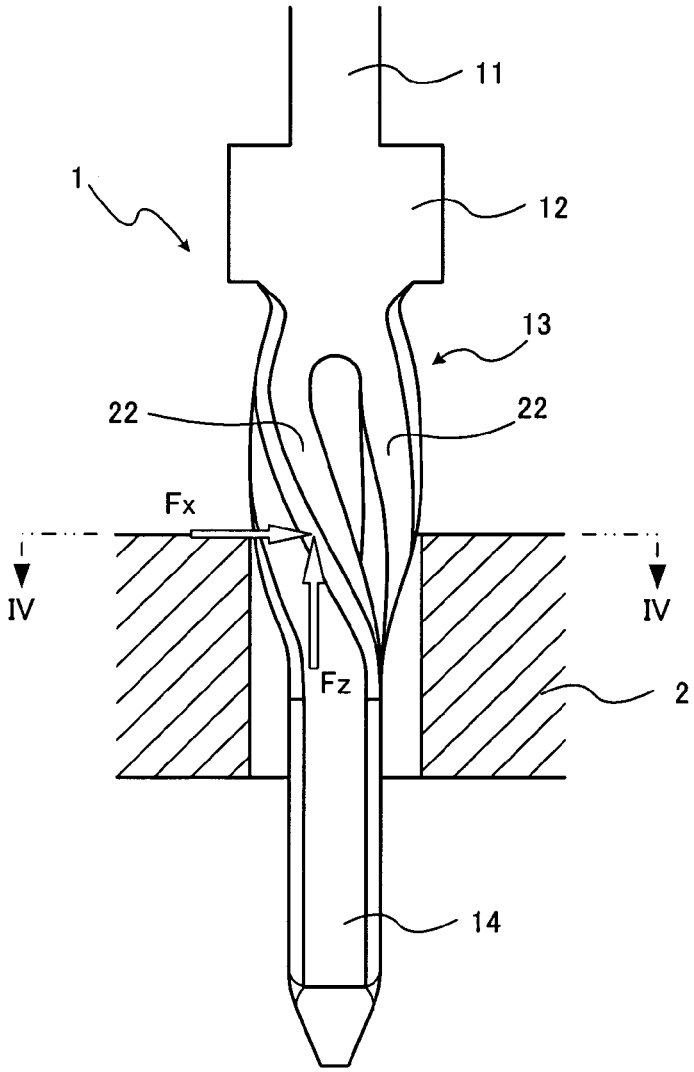
FIG. 3 shows a longitudinal cross-sectional view of a press-fit pin according to one embodiment of the invention just before the press-fit pin is press-fitted into a printed circuit board.
Figure 4:
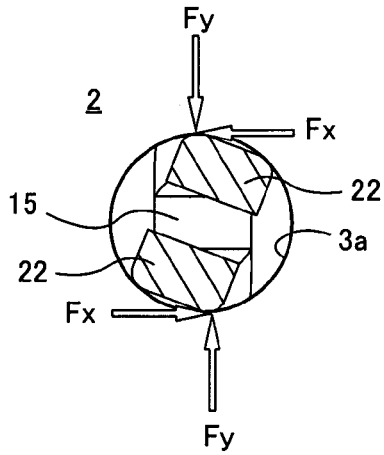
FIG. 4 shows a transverse cross-sectional view of a press-fit pin along the IV—IV line shown in FIG. 3.
Figure 5:
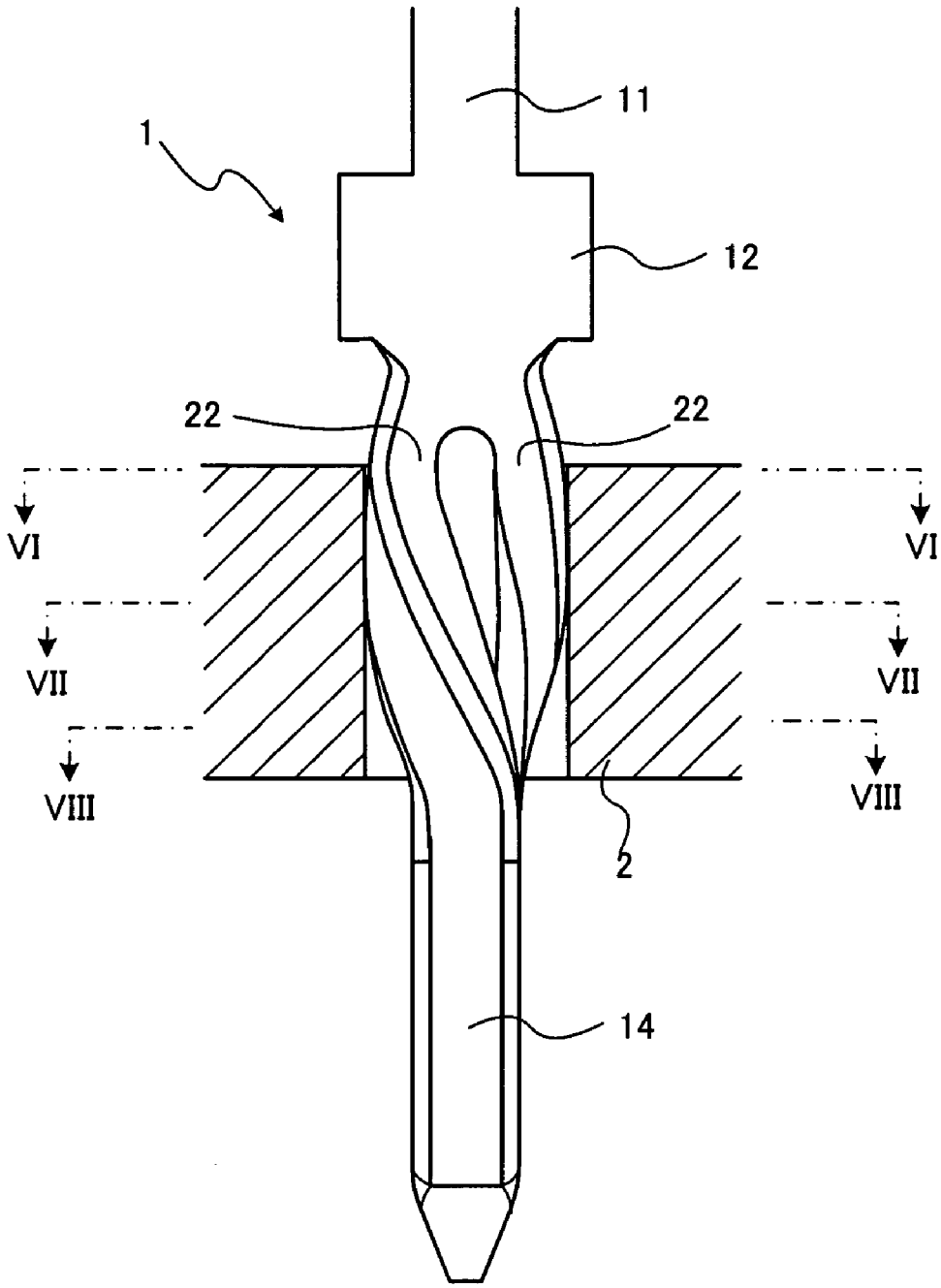
FIG. 5 shows a longitudinal cross-sectional view of the press-fit pin inserted into a printed circuit board to a predetermined position.

FIGS. 3 and 4 illustrate forces acting on the press-fit pin 1 when the press-fit pin 1 is being inserted into the through-hole 3 of the printed circuit board 2. For descriptive purposes, the same plane as the printed circuit board 2 is defined by an X direction and a Y direction, and a direction normal to the printed circuit board 2, i.e., an insertion direction, is defined as a Z direction. Referring now to FIG. 3, at an early stage of the insertion process, the press-fit portion 13 that is formed in a spirally-twisted structure comes into interference with the opening 3*b* of the through-hole 3. As the insertion further progresses, because of the spiral structure, reaction forces in the spiral direction with respect to the inner surface 3*a*, among other things, components Fx and Fy of the reaction force corresponding to a tangent direction and a radial direction, allow the press-fit portion 13 to be elastically deformed, and thereby the press-fit portion 13 interferes with the through-hole 3 with adequate contact pressure. During the insertion process, a load pressure to the through-hole 3 effectively disperses, thereby mitigating sudden changes of the insertion force, because the outer edges 23 of the press-fit portion 13 sink into the through-hole 3 in an oblique direction due to the spiral structure. Thus, fracture of the press-fit pin 1 and damages to the printed circuit board 2 can be prevented. Further, as shown in FIG. 5, when the press-fit pin 1 is press-fitted until a predetermined position, a portion of the press-fit portion 13 that interferes with the inner surface 3*a* of the through-hole 3 allows the press-fit pin 1 to be mechanically held by an adequate contact pressure acting in the spiral direction. The press-fit portion 13 is in pressure contact with the inner surface 3*a* in a spiral manner. Thus, compared with a straight manner, the effective contact area becomes longer. Increases in the effective contact area increase a friction force and reduce electrical contact resistance, thereby allowing the press-fit pin 1 to be securely fixed to the through-hole 3 of the printed circuit board 2.

Figure 6:
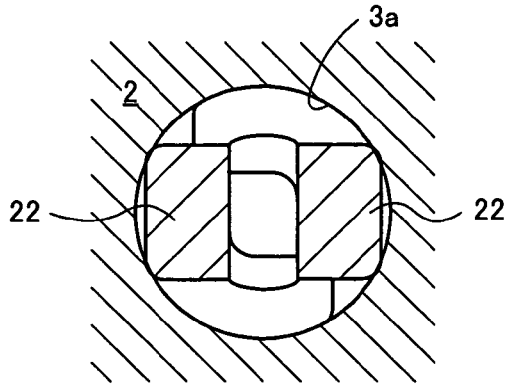
FIG. 6 shows a transverse cross-sectional view of the press-fit pin along the VI—VI line shown in FIG. 5.
Figure 7:
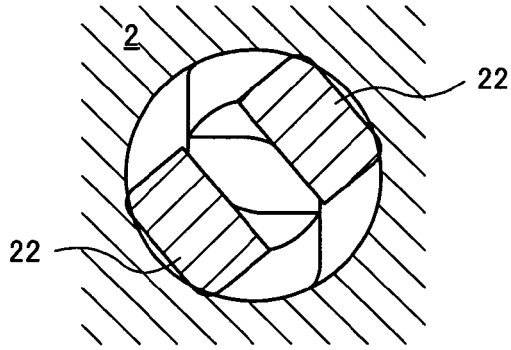
FIG. 7 shows a transverse cross-sectional view of the press-fit pin along the VII—VII line shown in FIG. 5.
Figure 8:
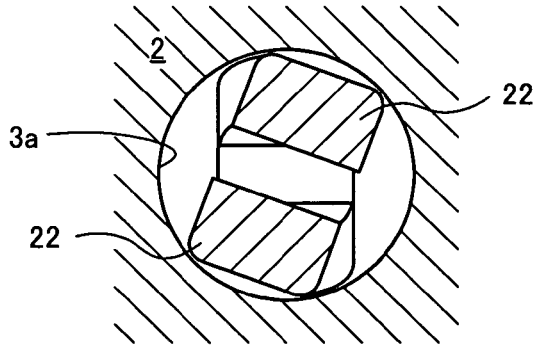
FIG. 8 shows a transverse cross-sectional view of the press-fit pin along the VIII—VIII line shown in FIG. 5.

FIGS. 6 through 8 illustrate cross-sectional views of the press-fit pin 1 press-fitted into the through-hole 3 shown in FIG. 5. As is apparent from these figures, the outer edges 23 of the press-fit portion 13 are in contact with the inner surface 3*a*, slightly pushing out the inner surface 3*a* by a radial elastic force.

Although the above-discussed embodiment is explained as taking the press-fit pin having the slit, those skilled in the art, having benefit of this disclosure, would appreciate that other modifications may be applied which do not depart from the scope of the invention as disclosed herein.

Figure 9:
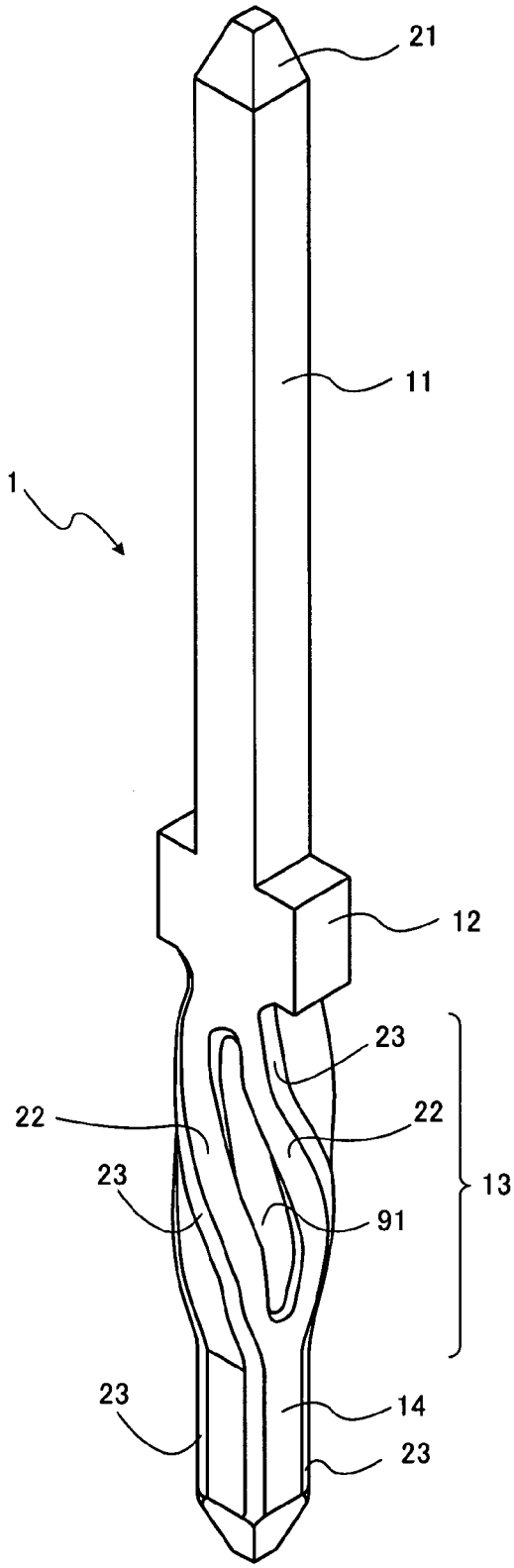
FIG. 9 shows a perspective view of a press-fit pin according to one embodiment of the invention.
Figure 10:
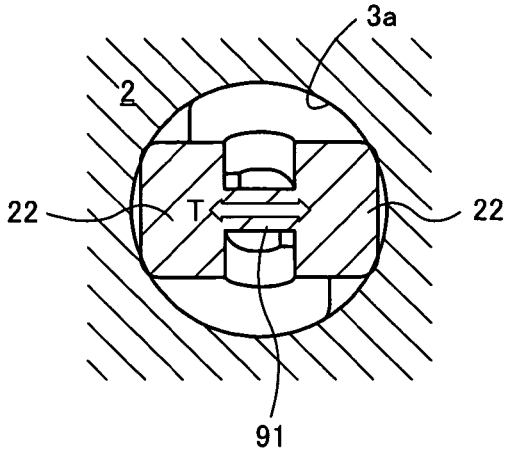
FIG. 10 shows a transverse cross-sectional view of a press-fit pin inserted into a printed circuit board according to one embodiment of the invention.
Figure 11:
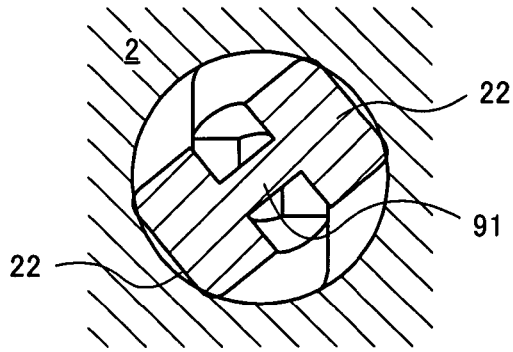
FIG. 11 shows a transverse cross-sectional view of a press-fit pin inserted into a printed circuit board according to one embodiment of the invention.
Figure 12:
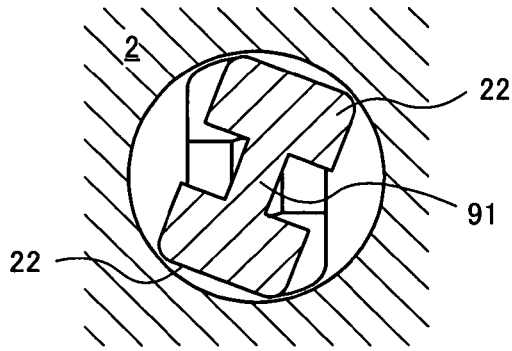
FIG. 12 shows a transverse cross-sectional view of a press-fit pin inserted into a printed circuit board according to one embodiment of the invention.

FIG. 9 illustrates a perspective view of a press-fit pin according to another embodiment of the invention. As shown in FIG. 9, a press-fit pin 1 includes a wall 91 supporting arm portions 22 that compose a press-fit portion 13. In other words, a slit is not formed on the press-fit portion 13. Specifically, as shown in FIGS. 10 through 12, a cross-section of the press-fit portion 13 is formed in a substantial I-shape. The wall 91 prevents undesirable distortion of the press-fit pin 1 due to an expressive insertion force, while, compared with the embodiment discussed above, it may restrain elastic deformation in a transverse direction T (FIG. 10). However, during the press-fitting, the press-fit portion 13 may be elastically deformed in a spiral direction by virtue of a spiral structure, and accordingly contact pressure may be properly assured without the elastic deformation in the transverse direction T.

In addition, because the outer edges 23 of the press-fit portion 13 sink into the through-hole 3 in a spiral direction, a load pressure to the printed circuit board 2 is effectively dispersed, and, as a consequence of this, damage to the printed circuit board 2 can be prevented. Further, an effective contact area between the press-fit portion 13 and the through-hole 3 is increased, and accordingly electrical contact resistance is reduced while a frictional force with the through-hole 3 is increased.

As a result of various configurations described in detail above, embodiments of the invention may include one or more following advantages, some of which have been discussed above. According to one embodiment of the invention, for example, a press-fit portion of a press-fit pin is formed in a spiral structure. Because of this structure, the press-fit portion can be elastically deformed in the spiral direction, and a frictional force with a through-hole of a printed circuit board is properly assured. During a process of press-fitting, the press-fit portion removes extraneous matter, such as oxide film or dust, from the inner surface of the through-hole. Furthermore, an effective contact area between the press-fit portion and the through-hole is increased, thereby reducing electrical contact resistance. During the insertion process, outer edges of the press-fit portion sink into the through-hole in a oblique direction because of the spiral structure thereof. Thus, a load pressure to the printed circuit board is dispersed, thereby mitigating sudden changes of the insertion force. Accordingly, fracture of the press-fit pin and damage to the printed circuit board can be prevented.

Furthermore, a lower portion of the press-fit portion may be tapered. Thus, excessive interference with the through-hole at an earlier stage of the press-fitting can be prevented.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A press-fit pin for mechanically and electrically connecting to a conductive through-hole of a substrate, comprising:

a contact portion;

a shoulder portion connected to the contact portion;

a press-fit portion connected to the shoulder portion having a first arm portion and a second arm portion extending in a longitudinal direction of the press-fit pin and defining an elongated aperture therebetween; and a tip portion connected to a distal end portion of both the first arm portion and the second arm portion;

wherein a first width is defined by a distance from a first side of the tip portion to a second opposite side of the tip portion;

wherein a second width is defined by a distance from an outer surface of the first arm portion to an outer surface of the second arm portion;

wherein the second width is greater than the first width where the press-fit pin is in an un-compressed state;

wherein the press-fit portion is helically twisted about the longitudinal direction when in the un-compressed state; and wherein outer edges of the press-fit portion are chamfered.

2. The press-fit pin according to claim 1, wherein the press-fit portion is tapered toward the tip portion.

3. A press-fit pin for mechanically and electrically connecting to a conductive through-hole of a substrate, comprising:

a contact portion:

a shoulder portion connected to the contact portion:

a press-fit portion connected to the shoulder portion having a first arm portion and a second arm portion extending in a longitudinal direction of the press-fit pin and defining an elongated aperture therebetween; and a tip portion connected to a distal end portion of both the first arm portion and the second arm portion;

wherein a first width is defined by a distance from a first side of the tip portion to a second opposite side of the tip portion;

wherein a second width is defined by a distance from an outer surface of the first arm portion to an outer surface of the second arm portion;

wherein the second width is greater than the first width where the press-fit pin is in an un-compressed state;

wherein the press-fit portion is helically twisted about the longitudinal direction when in the un-compressed state; and wherein the press-fit pin is a single molded piece.

4. A press-fit pin for mechanically and electrically connecting to a conductive through-hole of a substrate, comprising:

a contact portion;

a shoulder portion connected to the contact portion;

a press-fit portion connected to the shoulder portion having a first arm portion and a second arm portion extending in a longitudinal direction of the press-fit pin and defining an elongated aperture therebetween;

a tip portion connected to a distal end portion of both the first arm portion and the second arm portion; and an elongated wall extending between the first arm portion and the second arm portion within the aperture such that the press-fit portion has an H-shape in cross section, wherein a first width is defined by a distance from a first side of the tip portion to a second opposite side of the tip portion;

wherein a second width is defined by a distance from an outer surface of the first arm portion to an outer surface of the second arm portion;

wherein the second width is greater than the first width where the press-fit pin is in an un-compressed state; and wherein the press-fit portion is helically twisted about the longitudinal direction when in the un-compressed state.

5. A method of forming a press-fit mechanical and electrical connection, comprising:

providing a press-fit pin comprising:

a contact portion;

a shoulder portion connected to the contact portion;

a press-fit portion connected to the shoulder portion having a first arm portion and a second arm portion extending in a longitudinal direction of the press-fit pin and defining an elongated aperture therebetween; and a tip portion connected to a distal end portion of both the first arm portion and the second arm portion;

wherein a first width is defined by a distance from a first side of the tip portion to a second opposite side of the tip portion;

wherein a second width is defined by a distance from an outer surface of the first arm portion to an outer surface of the second arm portion;

wherein the second width is greater than the first width where the press-fit pin is in an un-compressed state;

wherein the press-fit portion is helically twisted about the longitudinal direction when in the un-compressed state; and wherein outer edges of the press-fit portion are chamfered; and inserting the press-fit pin in a conductive through-hole of a substrate to form the press-fit mechanical and electrical connection.

6. The method of forming a press-fit mechanical and electrical connection according to claim 5, wherein the press-fit portion is tapered toward the tip portion.

7. A method of forming a press-fit mechanical and electrical connection comprising:

providing a press-fit pin comprising:

a contact portion;

a shoulder portion connected to the contact portion;

a press-fit portion connected to the shoulder portion having a first arm portion and a second arm portion extending in a longitudinal direction of the press-fit pin and defining an elongated aperture therebetween; and a tip portion connected to a distal end portion of both the first arm portion and the second arm portion;

wherein a first width is defined by a distance from a first side of the tip portion to a second opposite side of the tip portion;

wherein a second width is defined by a distance from an outer surface of the first arm portion to an outer surface of the second arm portion;

wherein the second width is greater than the first width where the press-fit pin is in an un-compressed state;

wherein the press-fit portion is helically twisted about the longitudinal direction when in the un-compressed state; and wherein the press-fit pin is a single molded piece; and inserting the press-fit pin in a conductive through-hole of a substrate to form the press-fit mechanical and electrical connection.

8. A method of forming a press-fit mechanical and electrical connection, comprising:

providing a press-fit pin comprising:

a contact portion;

a shoulder portion connected to the contact portion;

a press-fit portion connected to the shoulder portion having a first arm portion and a second arm portion extending in a longitudinal direction of the press-fit pin and defining an elongated aperture therebetween; and a tip portion connected to a distal end portion of both the first arm portion and the second arm portion;

an elongated wall extending between the first arm portion and the second arm portion within the aperture such that the press-fit portion has an H-shape in cross section, wherein a first width is defined by a distance from a first side of the tip portion to a second opposite side of the tip portion;

wherein a second width is defined by a distance from an outer surface of the first arm portion to an outer surface of the second arm portion;

wherein the second width is greater than the first width where the press-fit pin is in an un-compressed state; and wherein the press-fit portion is helically twisted about the longitudinal direction when in the un-compressed state; and inserting the press-fit pin in a conductive through-hole of a substrate to form the press-fit mechanical and electrical connection.

9. The press-fit pin according to claim 3, wherein the press-fit portion is tapered toward the tip portion.

10. The method of forming a press-fit mechanical and electrical connection according to claim 7, wherein the press-fit portion is tapered toward the tip portion.

* * * * *